US011071679B2

(12) United States Patent
Burns et al.

(10) Patent No.: US 11,071,679 B2
(45) Date of Patent: Jul. 27, 2021

(54) PORTABLE THERAPEUTIC DEVICE AND ASSOCIATED USE THEREOF

(71) Applicants: Denise K. Burns, Port Washington, NY (US); Dorothy Belnavis, Elmont, NY (US); Donna Sbarro, Sands Point, NY (US)

(72) Inventors: Denise K. Burns, Port Washington, NY (US); Dorothy Belnavis, Elmont, NY (US); Donna Sbarro, Sands Point, NY (US)

( * ) Notice: Subject to any disclaimer, the term of this patent is extended or adjusted under 35 U.S.C. 154(b) by 0 days.

(21) Appl. No.: 16/907,903

(22) Filed: Jun. 22, 2020

(65) Prior Publication Data

US 2020/0323733 A1 Oct. 15, 2020

Related U.S. Application Data

(63) Continuation-in-part of application No. 15/622,593, filed on Jun. 14, 2017, now Pat. No. 10,729,612.
(Continued)

(51) Int. Cl.
*A61H 15/00* (2006.01)
*A61H 23/00* (2006.01)

(52) U.S. Cl.
CPC ..... *A61H 15/0078* (2013.01); *A61H 23/004* (2013.01); *A61H 2015/0042* (2013.01);
(Continued)

(58) Field of Classification Search
CPC .... A61H 15/02; A61H 15/0078; A61H 23/02; A61H 2015/0071; A61H 2201/0119;
(Continued)

(56) References Cited

U.S. PATENT DOCUMENTS 6,149,611 A * 11/2000 Chen ..... A61H 7/004 601/112
2002/0133872 A1 9/2002 Ferber
(Continued)

FOREIGN PATENT DOCUMENTS

DE 4019902 B1 11/1991
JP 2006068408 A1 3/2006
(Continued)

OTHER PUBLICATIONS

Quang D. Thanh, International Preliminary Report on Patentability, PCT application serial No. PCT/US17/37466, dated Jun. 14, 2018, Alexandria, VA.
(Continued)

*Primary Examiner* — Quang D Thanh
(74) *Attorney, Agent, or Firm* — Ashkan Najafi

(57) ABSTRACT

A portable therapeutic device includes a portable body having a recessed central region and a raised outer peripheral edge surrounding the recessed central region and directly engaged with the recessed central region, a plurality of massage balls seated at the recessed central region and spaced inside a perimeter of the raised outer peripheral edge, a thermal-conductive element channeled inside the outer peripheral edge and spaced from the recessed central region, and a power source communicatively coupled to the massage balls and the thermal-conductive element.

19 Claims, 7 Drawing Sheets

Related U.S. Application Data

(60) Provisional application No. 62/351,885, filed on Jun. 17, 2016.

(52) U.S. Cl.
CPC ..... *A61H 2201/0157* (2013.01); *A61H 2201/0207* (2013.01); *A61H 2201/1626* (2013.01); *A61H 2201/5097* (2013.01); *A61H 2205/081* (2013.01); *A61H 2205/088* (2013.01)

(58) Field of Classification Search
CPC .... A61H 2201/0157; A61H 2201/0207; A61H 2201/0214; A61H 2201/0221; A61H 2201/123; A61H 2201/1633; A61H 2201/1666; A61H 2201/5082; A61H 2201/5097; A61H 2201/0149; A61H 2201/1284; A61H 2201/1623; A61H 2201/1659; A61H 2203/0425; A61H 2205/086; A61H 7/001; A61H 2205/087
See application file for complete search history.

(56) References Cited

U.S. PATENT DOCUMENTS

| | | | | |
|---|---|---|---|---|
| 2005/0161985 | A1 | 7/2005 | Austin | |
| 2006/0207017 | A1 | 9/2006 | Lev et al. | |
| 2010/0081973 | A1* | 4/2010 | Tsai ..... | A61H 15/0078 601/134 |

FOREIGN PATENT DOCUMENTS

| | | | |
|---|---|---|---|
| KR | 2004061744 | A | 7/2004 |
| KR | 20150142531 | A1 | 12/2015 |
| WO | 2011149208 | A1 | 12/2011 |

OTHER PUBLICATIONS

International Search Report and Written Opinion dated Sep. 20, 2017 for related International Application No. PCT/US2017/037466, in 74 pages.

* cited by examiner

PORTABLE THERAPEUTIC DEVICE AND ASSOCIATED USE THEREOF

CROSS REFERENCE TO RELATED APPLICATIONS

This is a U.S. continuation patent application that claims the priority to and benefit of U.S. non-provisional patent application Ser. No. 15/622,593 filed Jun. 14, 2017, which claims the priority to and benefit of, U.S. provisional patent application No. 62/351,885 filed Jun. 17, 2016, both of which are incorporated by reference herein in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to therapeutic devices and, more particularly, to a lightweight portable therapeutic device that is specifically configured to offer healing therapy to the lower back, hips, pelvic and coccyx areas, thereby lifting and supporting the pelvic floor and frame. It includes rotatable massaging balls that directly massage the pelvic floor tissues and surrounding structures to alleviate pain, swelling and blood clots restrictions of joint motion, pressure and inflammation. The massaging balls are in communication with the heating and cooling system. The device treats chronic pelvic and abdominal organ swelling, congestion and inflammation like genitourinary (bladder, prostate, uterus) gastrointestinal (colon rectal hemorrhoids) in addition to musculoskeletal back pain and pelvic joint and soft tissue pain. The device may also include BLUETOOTH.®/WiFi capabilities as well as long range rechargeable batteries.

Prior Art

Low back pain and pelvic pain is a common musculoskeletal symptom that may be either acute or chronic. Caused by a variety of diseases and disorders that affect the lumbar spine, low back pain is often accompanied by sciatica, which is pain that involves the sciatic nerve and is felt in the lower back, the buttocks, the pelvis, the backs and sides of the thighs, and possibly the calves. A symptom that affects 80% of the general United States population at some point in life with sufficient severity to cause absence from work, low back/pelvic pain is the second most common reason for visits to primary care doctors, and is estimated to cost the American economy $75 billion every year.

In today's hectic and busy world, it is not uncommon for individuals to experience muscle tension, especially in the lower back, pelvis and coccyx (tailbone). Whether spending the day sitting in front of a computer screen, constantly bending and stooping while attending to household chores, or toiling with lawn and garden activities, these muscles tend to take on the stresses of physical and mental labor. At the end of such intense days, there is nothing that many would like more than to experience a soothing, relaxing massage to melt away the soreness in their bodies, as well as to ease the mind and cleanse the spirit. This need is so great that cities and towns are overflowing with professional massage therapists who enjoy a booming business attending to this need. However, it is simply not practical for many consumers to take time out of their busy work and home lives to visit a message therapist. In addition, these services can prove quite costly, with many professionals charging between $75 and $100 an hour for these treatments.

Accordingly, a need remains for a portable, therapeutic device in order to overcome at least one aforementioned shortcoming. The exemplary embodiment(s) satisfy such a need by providing a portable therapeutic device including a lightweight, rechargeable cooling/heating, support and massaging device that is specifically configured to offer healing therapy to the lower back, pelvis, and coccyx that is convenient and easy to use, lightweight yet durable in design, versatile in its applications, and designed for lifting and supporting the pelvic floor and frame, when seated on the device, as well as offer a hands-free, stress and pain relieving massage, to alleviate pressure, enhance circulation, prevent blood clots, and reduce pain in the lower back and genital region.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a portable therapeutic device to offer healing therapy to the lower back, pelvis, and coccyx thereby lifting and supporting a pelvic floor and frame as well as offer a hands-free, stress and pain relieving massage, to alleviate pressure, enhance circulation, prevent blood clots, and reduce pain in the lower back and a genital region. These and other objects, features, and advantages of the non-limiting exemplary embodiment(s) are provided by a portable therapeutic device including a portable body having a recessed central region and a raised outer peripheral edge surrounding the recessed central region and directly engaged with the recessed central region, a plurality of massage balls seated at the recessed central region and spaced inside a perimeter of the raised outer peripheral edge, a thermal-conductive element channeled inside the outer peripheral edge and spaced from the recessed central region, and a power source communicatively coupled to the massage balls and the thermal-conductive element.

In a non-limiting exemplary embodiment, the body includes a centrally registered longitudinal axis, a centrally registered latitudinal axis traversing the centrally registered longitudinal axis, a generally planar posterior face having a linear slot formed therein, a curvilinear anterior face oppositely seated from the posterior face, a planar top surface having a mesh layer removably seated thereon, and a planar bottom surface oriented parallel to the top surface and spaced subjacent thereto.

In a non-limiting exemplary embodiment, the body further includes an anchor bracket statically connected to the bottom surface and aligned along the centrally registered latitudinal axis, and a back-support brace slidably inserted into the linear slot and removably coupled to the posterior face. Advantageously, the back-support brace includes a linear aperture selectively engaged with the anchor bracket such that the back-support is selectively reciprocated along a linear path registered parallel to the bottom surface and the centrally registered latitudinal axis.

In a non-limiting exemplary embodiment, the body further includes a first lateral side and a second lateral side equidistantly offset from the centrally registered latitudinal axis, and a first lateral support flange and a second lateral support flange removably and adjustably coupled to the first lateral side and the second lateral side, respectively. Advantageously, each of the first lateral support flange and the second lateral support flange includes a contoured top surface, respectively, for supporting a hip/buttock portion of the user. Notably, the back-support brace 27 has a T-shaped upper portion that is capable of vibrating and being heated/cooled to a desired temperature. The T-shaped upper portion of the back-support brace 27 is advantageous, because a lot of pain is generated in the lumbar area consequently the T-shaped upper portion has the ability to deliver specific heating and cooling to the spinal nerves.

In a non-limiting exemplary embodiment, the plurality of massage balls includes a first transducer having a solid top sphere protruding upwardly and out from the top surface, a hollow bottom section monolithically formed with the solid top sphere and extending downwardly below the top surface wherein the hollow bottom section is nested on the bottom surface, and a powered actuator in communication with the power source. The power source may be intercalated between the top surface and the bottom surface. Advantageously, such a powered actuator is penetrated upwardly through the hollow bottom section and operably coupled to the solid top sphere. In this manner, the powered actuator causes the solid top sphere to oscillate along a multi-directional path.

In a non-limiting exemplary embodiment, the plurality of massage balls further includes a second transducer coextensively shaped with the first transducer.

In a non-limiting exemplary embodiment, the raised outer peripheral edge includes a hollow channel extending along an entire longitudinal length thereof. Notably, the thermal-conductive element includes a helical coil communicatively coupled to the power source and seated inside the hollow channel. Such a helical coil is capable of being selectively heated and cooled between a predetermined temperature range.

In a non-limiting exemplary embodiment, the bottom surface includes a plurality of spaced apertures, and a plurality of support legs threadably inserted into the spaced apertures, respectively, such that a height, relative to a ground surface, is independently altered at each the posterior face, the anterior face, the first lateral side and the second lateral side. For example, such support legs may be positioned at opposed corners of the bottom surface.

In a non-limiting exemplary embodiment, the first lateral flange and the second lateral flange are coextensively shaped.

The present disclosure further includes a method of utilizing a portable therapeutic device to offer healing therapy to the lower back, pelvis, and coccyx thereby lifting and supporting a pelvic floor and frame as well as offer a hands-free, stress and pain relieving massage, thereby alleviating pressure, enhancing circulation, preventing blood clots, and reducing pain in the lower back and a genital region. Such a method includes the steps of: providing a portable body having a recessed central region and a raised outer peripheral edge surrounding the recessed central region and directly engaged with the recessed central region; providing and seating a plurality of massage balls at the recessed central region; spacing the massage balls inside a perimeter of the raised outer peripheral edge; providing and channeling a thermal-conductive element inside the outer peripheral edge thereby spacing the thermal-conductive element from the recessed central region; and providing and communicatively coupling a power source to the massage balls and the thermal-conductive element.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
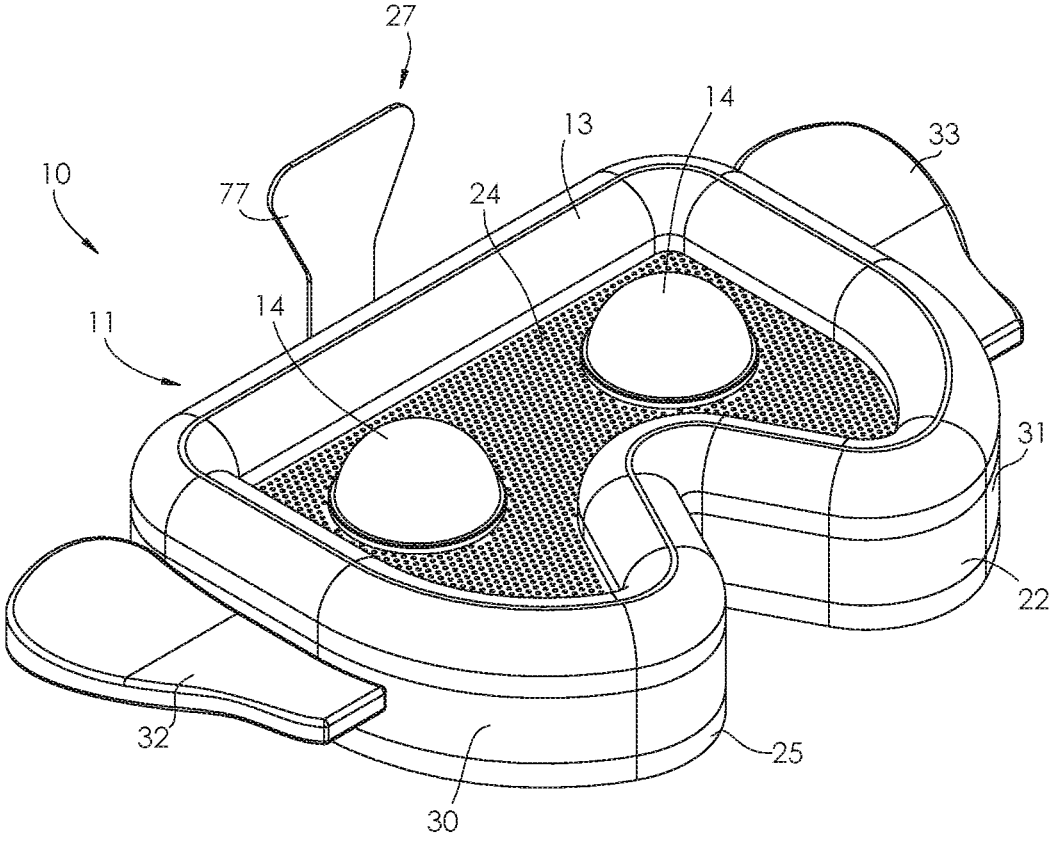
FIG. 1 is a perspective view of a portable therapeutic device, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

Figure 2:
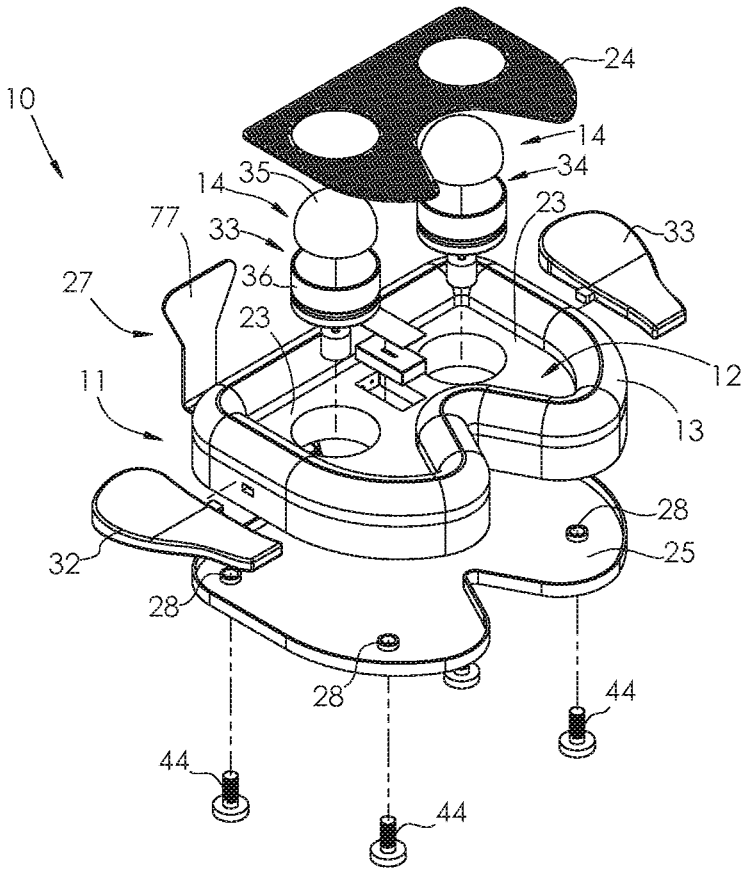
FIG. 2 is an exploded view of the portable therapeutic device shown in FIG. 1.
Figure 3:
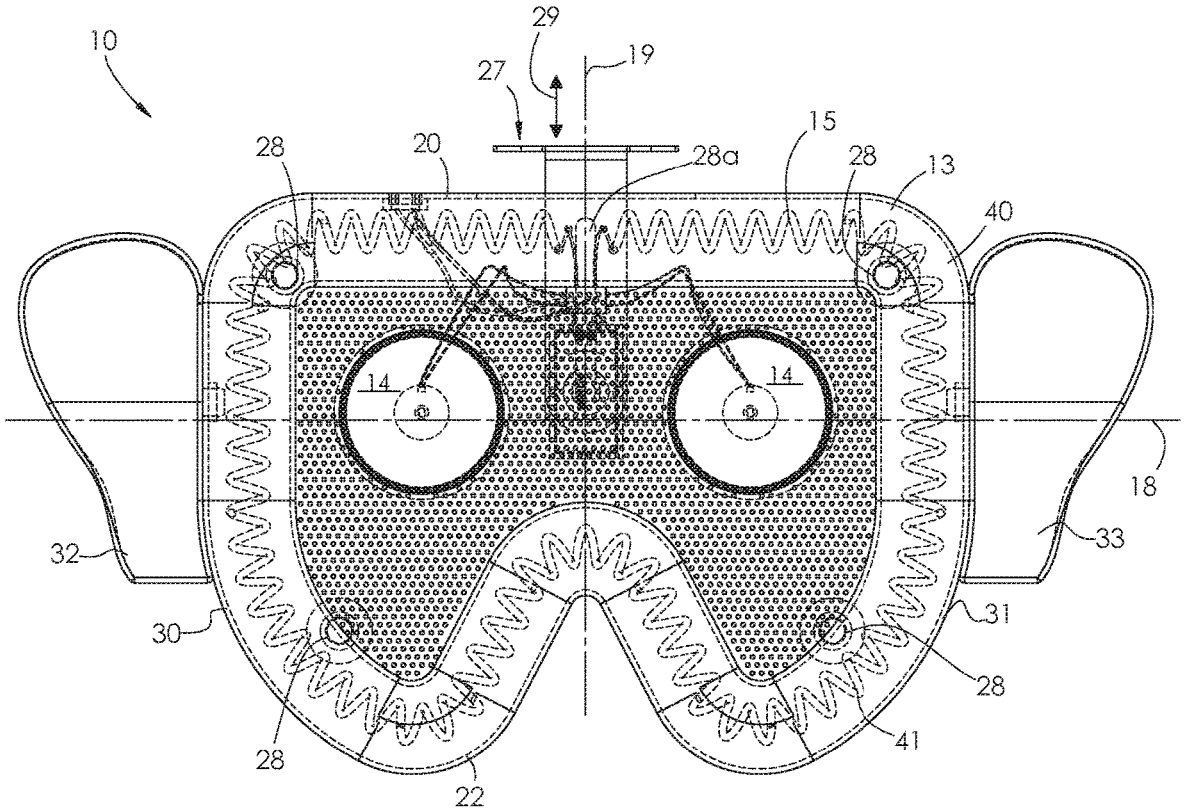
FIG. 3 is an enlarged, partially transparent top plan view of the portable therapeutic device shown in FIG. 1.
Figure 4:
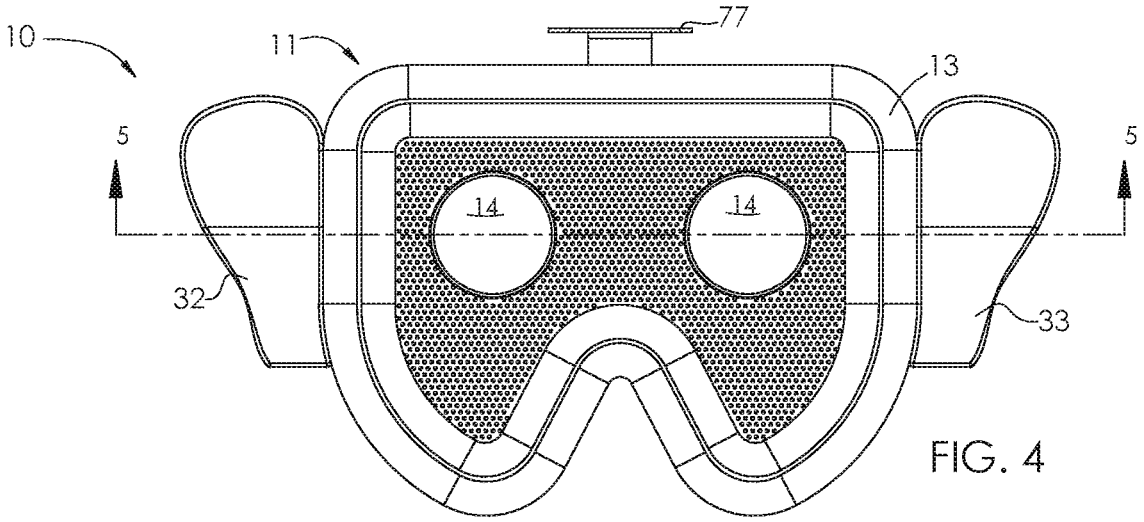
FIG. 4 is a top plan view of the portable therapeutic device shown in FIG. 1.
Figure 5:
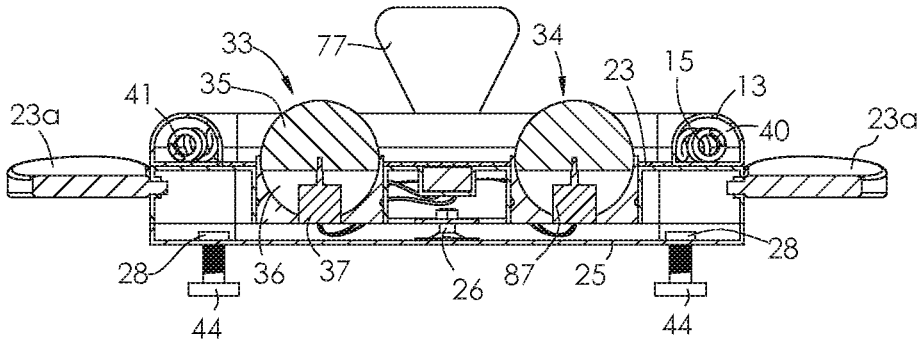
FIG. 5 is a cross-sectional view taken along line 5-5 in FIG. 4.
Figure 6:
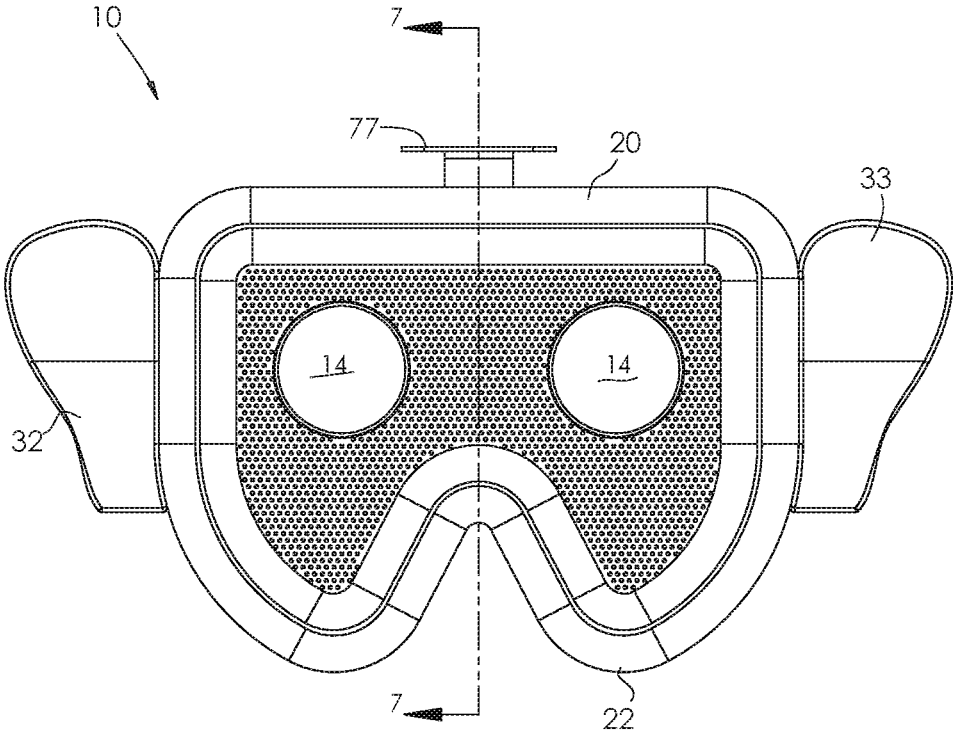
FIG. 6 is a top plan view of the portable therapeutic device shown in FIG. 1.
Figure 7:
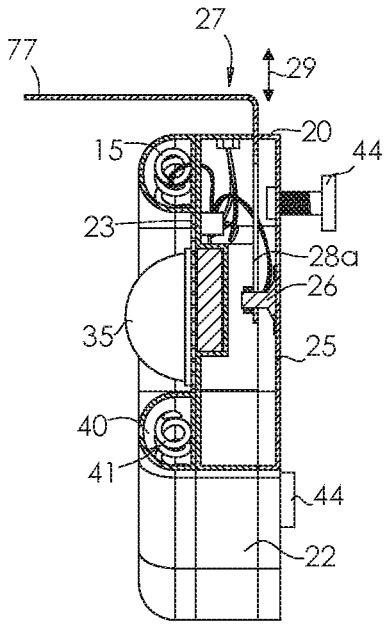
FIG. 7 is a cross-sectional view taken along line 7-7 in FIG. 6.
Figure 8:
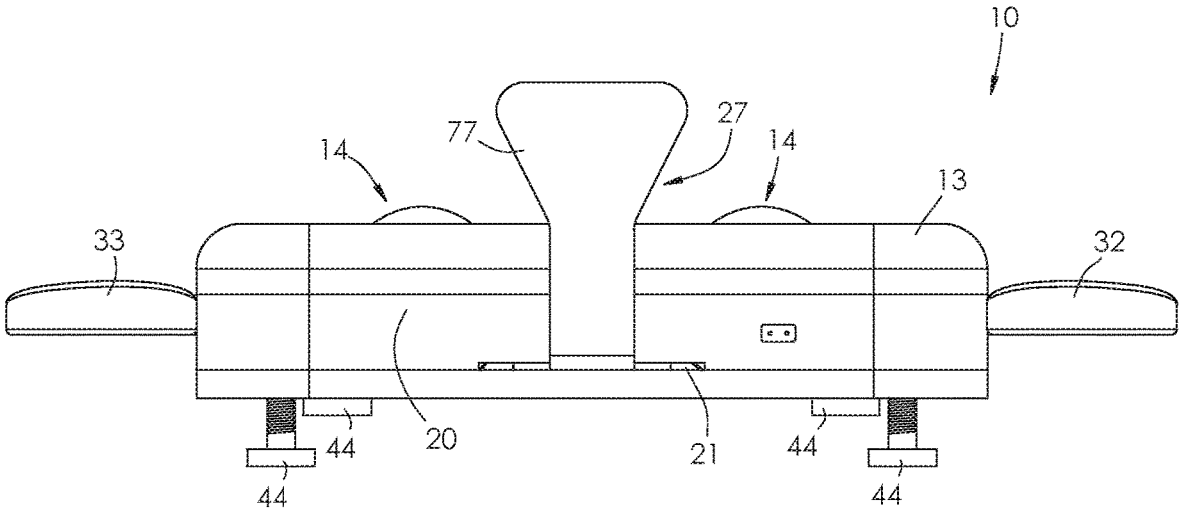
FIG. 8 is a rear elevational view of the portable therapeutic device shown in FIG. 1.
Figure 9:
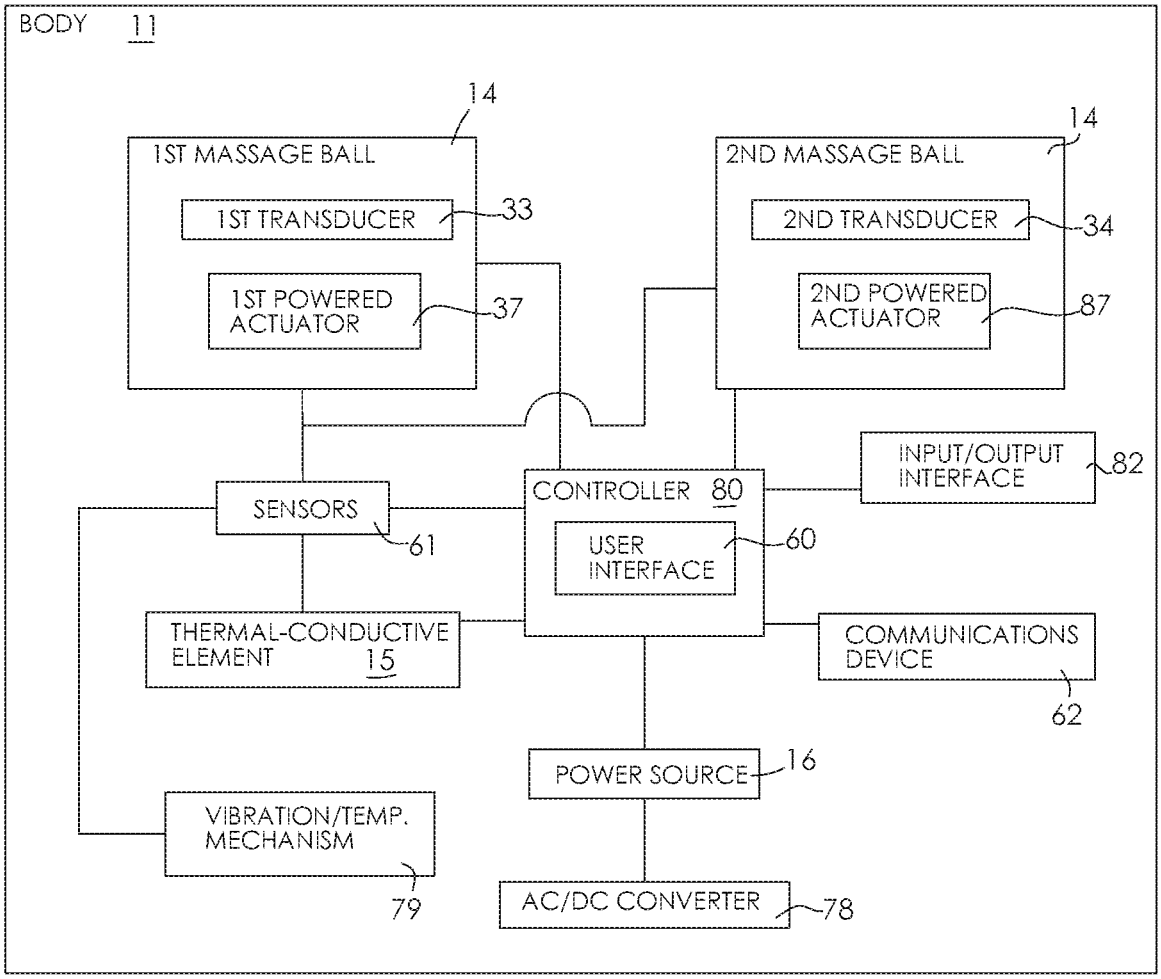
FIG. 9 is a high-level schematic block diagram illustrating the interrelationship between the major electronic components of the portable therapeutic device, in accordance with a non-limiting exemplary embodiment.

The non-limiting exemplary embodiment(s) is/are referred to generally in FIGS. 1-9 and is/are intended to provide a portable therapeutic device 10 including a portable body 11 having a recessed central region 12 and a raised outer peripheral edge 13 surrounding the recessed central region 12 and directly engaged with the recessed central region 12, a plurality of massage balls 14 seated at the recessed central region 12 and spaced inside a perimeter of the raised outer peripheral edge 13, a thermal-conductive element 15 channeled inside the outer peripheral edge 13 and spaced from the recessed central region 12, and a power source 16 communicatively coupled to the massage balls 14 and the thermal-conductive element 15. Such a structural configuration provides the unexpected and unpredictable benefit of providing healing therapy to the lower back, pelvis, and coccyx thereby lifting and supporting a pelvic floor and frame as well as offer a hands-free, stress and pain relieving massage, to alleviate pressure, enhance circulation, prevent blood clots, and reduce pain in the lower back and a genital region.

In a non-limiting exemplary embodiment, the power source 16 may include one or more rechargeable or non-rechargeable disposable batteries, photovoltaic cells, and/or an AC adapter or other power supply means. For example, a charge cable, AC/DC converter 78 and/or transformer may be provided to step down an incoming voltage level from an exterior wall outlet, as needed.

In a non-limiting exemplary embodiment, the body 11 includes a centrally registered longitudinal axis 18, a centrally registered latitudinal axis 19 traversing the centrally registered longitudinal axis 18, a generally planar posterior face 20 having a linear slot 21 formed therein, a curvilinear anterior face 22 oppositely seated from the posterior face 20, a planar top surface 23 having a mesh layer 24 removably seated thereon, and a planar bottom surface 25 oriented parallel to the planar top surface 23 and spaced subjacent thereto.

In a non-limiting exemplary embodiment, the body 11 further includes an anchor bracket 26 statically connected to the bottom surface 25 and aligned along the centrally registered latitudinal axis 19, and a back-support brace 27 slidably inserted into the linear slot 21 and removably coupled to the posterior face 20. Advantageously, the back-support brace 27 has includes a linear aperture **28*a* selectively engaged with the anchor bracket 26 such that the back-support brace 27 is selectively reciprocated along a linear path 29 registered parallel to the bottom surface 25 and the centrally registered latitudinal axis 19. In this manner, the back-support brace 27 may be an optional accessory that is detachably connected to the body 11**, as desired by the user.

Notably, the back-support brace 27 has a T-shaped upper portion 77 that is capable of vibrating and being heated/cooled to a desired temperature. The T-shaped upper portion 77 of the back-support brace 27 is advantageous, because a lot of pain is generated in the lumbar area consequently the T-shaped upper portion 77 has the ability to deliver specific heating and cooling to the spinal nerves.

In a non-limiting exemplary embodiment, the body 11 further includes a first lateral side 30 and a second lateral side 31 equidistantly offset from the centrally registered latitudinal axis 19, and a first lateral support flange 32 and a second lateral support flange 33 removably and adjustably coupled to the first lateral side 30 and the second lateral side 31, respectively. Advantageously, each of the first lateral support flange 32 and the second lateral support flange 33 includes a contoured top surface **23*a*, respectively, for supporting a hip/buttock portion of the user. In this manner, the first lateral side 30 and a second lateral side 31 may be optional accessories that are detachably connected to the body 11, as desired by the user. Each of the first lateral support flange 32 and second lateral support flange 33** may vibrate and heated/cooled via a user interface.

In a non-limiting exemplary embodiment, the plurality of massage balls 14 includes a first transducer 33 having a solid top sphere 35 protruding upwardly and out from the top surface 23, a hollow bottom section 36 monolithically formed with the solid top sphere 35 and extending downwardly below the top surface 23 wherein the hollow bottom section 36 is nested on the bottom surface 25, and a powered actuator 37 in communication with the power source 16. The power source 16 may be intercalated between the top surface 23 and the bottom surface 25. Advantageously, such a powered actuator 37 is penetrated upwardly through the hollow bottom section 36 and operably coupled to the solid top sphere 35. In this manner, the powered actuator 37 causes the solid top sphere 35 to oscillate along a multi-directional path 29 (e.g., two or more of an x-direction, y-direction, and z-direction).

In a non-limiting exemplary embodiment, the transducers 33, 34 (massage balls 14) may include a mechanical or electro-mechanical device 79 that is capable of generating heating/cooling temperatures, and/or vibrations at a desired intensity and temperature range.

In a non-limiting exemplary embodiment, a plurality of guide tracks may be formed along the top surface 23 of body 11 such that each massage ball 14 can be selectively displaced along a desired path 29 within the recessed central region 12.

In a non-limiting exemplary embodiment, a controller 80 and a user interface 60 may be provided, which may include a variety of stand-alone or shared devices that are capable of generating and transmitting a control signal upon receiving a user input. For example, exemplary user interface devices may include a remote controller employing RF, infra-red, acoustic or cellular technology, as well known in the industry. In alternate embodiments, the user interface may include a handheld computer, a PDA, a cell phone, a keyboard, a mouse, etc. that may be comprised of commercially available hardware and software operating systems, for example. The aforementioned user interfaces are intended to represent a broad category of exemplary user interfaces capable of functioning in accordance with the present disclosure.

In a non-limiting exemplary embodiment, one or more sensor(s) 61, such as a motion and/or light sensor(s) may be provided to cause the present disclosure for detecting an event, for example. Events may be associated with the time and manner in which the device is employed by a user. Active and/or passive sensors may be used to react to detectable subject matter such as light, noise, radiation (e.g., heat), or changes in emitted energy, fields or beams. However, the disclosure is not limited to a particular type of sensor. Those skilled in the art will appreciate that other sensors may be used without departing from the scope of the disclosure. Examples of such other sensors include pressure sensitive mats; optical sensors configured to sense light; microwave sensors that use a Gunn diode operating within pre-set limits to transmit/flood a designated area/zone with an electronic field whereby movement in the zone disturbs the field and sets off an alarm; an ultrasonic sensor configured to react to a determined range of ultrasonic sound energy in a protected area; or any other sensor capable of providing motion detection capability in accordance with principles of the disclosure.

In a non-limiting exemplary embodiment, a communications device 62 may communicate with various components of the body 11 (e.g., sensors) using one or more wireless LAN (WLAN) protocols, using low power, ultra wide band (UWB) communication signals or some other type of wireless signals for RF or optical (e.g., infrared) communication of information to a peripheral electronic device 63 such as a smart phone, tablet, laptop, etc. Thus, data learned from sensors attached to various components of the body 11 may be transmitted and formatted for review, as desired.

In a non-limiting exemplary embodiment, a real-time WLAN protocol or a standard wireless LAN protocol such as that of IEEE 802.11.times., Bluetooth or IrDA may be used without departing from the scope of the present disclosure. A local network that connects the communications device 62 to their respective local computer systems may, for example, include a single, unified full duplex LAN, such as a 100BaseT Ethernet LAN. Alternatively, the local network may include two or more interconnected LANs or other network communications means. Any of a variety of other types of computer systems and associated applications may be provided on the network.

Optionally, various ports and interfaces may be provided to communicate with peripherals, subsystems and systems. For example, an input/output interface 82 may include serial ports for bi-directional communications, and/or an optical communication (e.g., infrared) port for wireless line of sight communications. Other ports may include parallel and USB ports.

In a non-limiting exemplary embodiment, the plurality of massage balls 14 further includes a second transducer 34 coextensively shaped with the first transducer 33. The components of the massage balls 14 are preferably identical. Thus, the second transducer 34 includes a second powered actuator 87, which operates in a same manner as the first powered actuator 37.

In a non-limiting exemplary embodiment, the raised outer peripheral edge 13 includes a hollow channel 40 extending along an entire longitudinal length thereof. Notably, the thermal-conductive element 15 includes a helical coil 41 communicatively coupled to the power source 16 and seated inside the hollow channel 40. Such a helical coil 41 is capable of being selectively heated and cooled between a predetermined temperature range.

In a non-limiting exemplary embodiment, the bottom surface 25 includes a plurality of spaced apertures 28, and a plurality of support legs 44 threadably inserted into the spaced apertures 28, respectively, such that a height, relative to a ground surface, is independently altered at each the posterior face 20, the anterior face 22, the first lateral side 30 and the second lateral side 31. For example, such support legs 44 may be positioned at opposed corners of the bottom surface 25.

In a non-limiting exemplary embodiment, the first lateral support flange 32 and the second lateral support flange 33 are coextensively shaped.

In a non-limiting exemplary embodiment, an operating switch 89 may be communicatively coupled to the controller 80 and sensors 61. Such an operating switch 89 may be manually toggled between on/off modes by the user. In addition, operating switch 89 may be automatically toggled between on/off modes by controller 80. For example, sensors 61 periodically detect a real-time temperature of heating coil 41 (and other components) and provide a corresponding detection signal to controller 80. The detection signal is learned by controller 80 and if the real-time temperature is above a maximum threshold temperature, the controller 80 generates and transmits an off signal to operating switch 89 (open the switch), thereby discontinuing a power supply and interrupting operation thereof. It is understood that various components of device 10 may be selectively toggled between on/off modes, and it is not limited to only the massaging balls 14.

The present disclosure further includes a method of utilizing a portable therapeutic device 10 to offer healing therapy to the lower back, pelvis, and coccyx thereby lifting and supporting a pelvic floor and frame as well as offer a hands-free, stress and pain relieving massage, thereby alleviating pressure, enhancing circulation, preventing blood clots, and reducing pain in the lower back and a genital region. Such a method includes the steps of: providing a portable body 11 having a recessed central region 12 and a raised outer peripheral edge 13 surrounding the recessed central region 12 and directly engaged with the recessed central region 12; providing and seating a plurality of massage balls 14 at the recessed central region 12; spacing the massage balls 14 inside a perimeter of the raised outer peripheral edge 13; providing and channeling a thermal-conductive element 15 inside the outer peripheral edge 13 thereby spacing the thermal-conductive element 15 from the recessed central region 12; and providing and communicatively coupling a power source 16 to the massage balls 14 and the thermal-conductive element 15.

A non-limiting exemplary embodiment(s) of the present disclosure is referred to generally in FIGS. 1-9 and is intended to provide a portable therapeutic device 10 including a lightweight, rechargeable cooling/heating, support and massaging device 10 that is specifically configured to offer healing therapy to the lower back, pelvis, and coccyx thereby lifting and supporting the pelvic floor and frame, when seated on the device 10, as well as offer a hands-free, stress and pain relieving massage, to alleviate pressure, enhance circulation, prevent blood clots, and reduce pain in the lower back and genital region. It should be understood that the exemplary embodiment(s) may be used to with a variety of users, and should not be limited to any particular user described herein.

Referring to FIGS. 1-9 in general, in a non-limiting exemplary embodiment(s), the therapeutic device 10 is a practical, affordable device that allows consumers to receive a relieving massage right in the comforts of home. Simply stated, the therapeutic device 10 is envisioned as a specially designed massaging device 10 that is specifically configured to offer healing therapy to the lower back, pelvis and coccyx. Presented as a circular/heart-shaped device 10 that is designed for users to comfortably sit upon, the therapeutic device 10 achieves its intended purpose by elevating and supporting the pelvic floor and frame, which, along with its massager, would alleviate pressure and increase circulation, and decrease edema lower pelvic floor extremities.

The massaging capabilities of the therapeutic device 10 include a number of rotating discs outfitted with two massaging balls 14 in a circular formation. The vibration, along with a handy internal heating and cooling element, may be powered by a rechargeable battery pack sourced from nickel cadmium or nickel metal hydride, which would be operated by an external switch that could allow for optional speed settings. There could also be an additional battery included to be sure that a fully charged battery is readily available at all times.

Use of the therapeutic device 10 described as follows: powering on the massager, the user employs the external switch to select the massaging speed that is most preferable. By way of example, a mother may wish to enjoy a low impact, soothing sensation and set the speed for low. Conversely, a construction worker may need a deep tissue rub, and would thus choose the more vigorous high speed. Powering on the therapeutic device 10, the user can simply administer a massage to the lower back and coccyx for as long as desired. In this manner, the user is able to spoil him- or herself with loving attention even while watching TV, working on the computer, talking on the phone, or even driving in the car. This product may be used at the workplace, airplanes and many other locations and for long distance traveling as well.

There are several significant benefits and advantages associated with this unique product disclosure. Foremost, the therapeutic device 10 provides a convenient means of therapeutic massage whenever one is needed. Eliminating the need to take time out of busy days and evenings to visit an expensive massage therapist, this handy, cost-effective product offers instant stress relief right at home, whether first thing in the morning or in the middle of the night. Specifically concentrating on the lower back, pelvis and coccyx areas of the body 11, the therapeutic device's 10 finely tuned components help ensure that these areas receive proper and precise treatment.

In addition to relieving pain and improving circulation, the therapy provided by the therapeutic device 10 help improve a host of other maladies, including acute and chronic GI inflammation, hemorrhoids, and vaginal pain, to name just a few examples. While this product was primarily conceived with household users in mind, the therapeutic device 10 is an invaluable addition to hospital physical therapy rooms, as well as a much-appreciated luxury for hotels and day spas to offer their guests. The therapeutic device 10 is an innovative product that offers consumers an easy and effective means of relieving venous/Lymph congestion, stress and muscle tension. Cleverly designed, the universal configuration of this unit accommodates a variety of users.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A portable therapeutic device to offer healing therapy to a lower back, pelvis, and coccyx of a user thereby lifting and supporting a pelvic floor and frame of the user as well as offer a hands-free, stress and pain relieving massage, to alleviate pressure, enhance circulation, prevent blood clots, and reduce pain in the lower back and a genital region of the user, said portable therapeutic device comprising:

a body having a recessed central region and a raised outer peripheral edge surrounding said recessed central region;

a plurality of massage balls seated at said recessed central region;

a thermal-conductive element seated inside a hollow channel of said raised outer peripheral edge and spaced from said recessed central region; and a power source electrically coupled to said massage balls and said thermal-conductive element;

wherein said body is configured for the user to comfortably sit thereupon and further configured to elevate and support the pelvic floor and frame of the user, which, along with said massage balls is configured to alleviate pressure and increase circulation, and decrease edema in a tissue of lower pelvic floor extremities of the user.

2. The portable therapeutic device of claim 1, wherein said body comprises:

a centrally registered longitudinal axis;

a centrally registered latitudinal axis traversing said centrally registered longitudinal axis;

a generally planar posterior face having a linear slot formed therein;

a curvilinear anterior face oppositely seated from said posterior face;

a planar top surface having a mesh layer removably seated thereon; and a planar bottom surface oriented parallel to said top surface and spaced subjacent thereto.

3. The portable therapeutic device of claim 2, wherein said body further comprises:

an anchor bracket statically connected to said bottom surface and aligned along said centrally registered latitudinal axis; and a back-support brace slidably inserted into said linear slot and removably coupled to said posterior face;

wherein said back-support brace includes a linear aperture selectively engaged with said anchor bracket such that said back-support brace is selectively reciprocated along a linear path registered parallel to said bottom surface and the centrally registered latitudinal axis.

4. The portable therapeutic device of claim 2, wherein said body further comprises:

a first lateral side and a second lateral side equidistantly offset from the centrally registered latitudinal axis; and a first lateral support flange and a second lateral support flange removably and adjustably coupled to said first lateral side and said second lateral side, respectively;

wherein each of said first lateral support flange and said second lateral support flange includes a contoured top surface, respectively.

5. The portable therapeutic device of claim 2, wherein said plurality of massage balls comprises: a first transducer including a solid top sphere protruding upwardly and out from said top surface;

a hollow bottom section monolithically formed with said solid top sphere and extending downwardly below said top surface, said hollow bottom section being nested on said bottom surface; and a powered actuator in communication with said power source, said powered actuator penetrating upwardly through said hollow bottom section and operably coupled to said solid top sphere;

wherein said powered actuator causes said solid top sphere to oscillate along a multi-directional path;

wherein said power source is intercalated between said top surface and said bottom surface.

6. The portable therapeutic device of claim 5, wherein said plurality of massage balls further comprises: a second transducer coextensively shaped with said first transducer.

7. The portable therapeutic device of claim 2, wherein said raised outer peripheral edge comprises: the hollow channel extending along an entire longitudinal length thereof; wherein said thermal-conductive element includes a helical coil communicatively coupled to said power source and seated inside said hollow channel, said helical coil capable of being selectively heated and cooled between a predetermined temperature range.

8. The portable therapeutic device of claim 2, wherein said bottom surface comprises:

a plurality of spaced apertures; and a plurality of support legs threadably inserted into said spaced apertures, respectively, such that a height, relative to a ground surface, is independently altered at each said posterior face, said anterior face, said first lateral side and said second lateral side.

9. The portable therapeutic device of claim 4, wherein said first lateral support flange and said second lateral support flange are coextensively shaped.

10. A portable therapeutic device to offer healing therapy to a lower back, pelvis, and coccyx of a user thereby lifting and supporting a pelvic floor and frame of the user as well as offer a hands-free, stress and pain relieving massage, to alleviate pressure, enhance circulation, prevent blood clots, and reduce pain in the lower back and a genital region of the user, said portable therapeutic device comprising:

a portable body having a recessed central region and a raised outer peripheral edge surrounding said recessed central region and directly engaged with said recessed central region;

a plurality of massage balls seated at said recessed central region and spaced inside a perimeter of said raised outer peripheral edge;

a thermal-conductive element seated inside a hollow channel of said raised outer peripheral edge and spaced from said recessed central region; and a power source communicatively and electrically coupled to said massage balls and said thermal-conductive element;

wherein said body is configured to offer healing therapy to the lower back, pelvis and coccyx of the user;

wherein said body is configured for the user to comfortably sit thereupon and further configured to elevate and support the pelvic floor and frame of the user, which, along with said massage balls is configured to alleviate pressure and increase circulation, and decrease edema in a tissue of lower pelvic floor extremities of the user.

11. The portable therapeutic device of claim 10, wherein said body comprises:

a centrally registered longitudinal axis;

a centrally registered latitudinal axis traversing said centrally registered longitudinal axis;

a generally planar posterior face having a linear slot formed therein;

a curvilinear anterior face oppositely seated from said posterior face;

a planar top surface having a mesh layer removably seated thereon; and a planar bottom surface oriented parallel to said top surface and spaced subjacent thereto.

12. The portable therapeutic device of claim 11, wherein said body further comprises:

an anchor bracket statically connected to said bottom surface and aligned along said centrally registered latitudinal axis; and a back-support brace slidably inserted into said linear slot and removably coupled to said posterior face;

wherein said back-support brace includes a linear aperture selectively engaged with said anchor bracket such that said back-support brace is selectively reciprocated along a linear path registered parallel to said bottom surface and the centrally registered latitudinal axis.

13. The portable therapeutic device of claim 11, wherein said body further comprises:

a first lateral side and a second lateral side equidistantly offset from the centrally registered latitudinal axis; and a first lateral support flange and a second lateral support flange removably and adjustably coupled to said first lateral side and said second lateral side, respectively;

wherein each of said first lateral support flange and said second lateral support flange includes a contoured top surface, respectively.

14. The portable therapeutic device of claim 11, wherein said plurality of massage balls comprises: a first transducer including a solid top sphere protruding upwardly and out from said top surface;

a hollow bottom section monolithically formed with said solid top sphere and extending downwardly below said top surface, said hollow bottom section being nested on said bottom surface; and a powered actuator in communication with said power source, said powered actuator penetrating upwardly through said hollow bottom section and operably coupled to said solid top sphere;

wherein said powered actuator causes said solid top sphere to oscillate along a multi-directional path;

wherein said power source is intercalated between said top surface and said bottom surface.

15. The portable therapeutic device of claim 14, wherein said plurality of massage balls further comprises: a second transducer coextensively shaped with said first transducer.

16. The portable therapeutic device of claim 11, wherein said raised outer peripheral edge comprises: the hollow channel extending along an entire longitudinal length thereof; wherein said thermal-conductive element includes a helical coil communicatively coupled to said power source and seated inside said hollow channel, said helical coil capable of being selectively heated and cooled between a predetermined temperature range.

17. The portable therapeutic device of claim 11, wherein said bottom surface comprises:

a plurality of spaced apertures; and a plurality of support legs threadably inserted into said spaced apertures, respectively, such that a height, relative to a ground surface, is independently altered at each said posterior face, said anterior face, said first lateral side and said second lateral side.

18. The portable therapeutic device of claim 13, wherein said first lateral support flange and said second lateral support flange are coextensively shaped.

19. A method of utilizing a portable therapeutic device to offer healing therapy to a lower back, pelvis, and coccyx of a user thereby lifting and supporting a pelvic floor and frame of the user as well as offer a hands-free, stress and pain relieving massage, thereby alleviating pressure, enhancing circulation, preventing blood clots, and reducing pain in the lower back and a genital region of the user, said method comprising the steps of:

providing a portable body having a recessed central region and a raised outer peripheral edge surrounding said recessed central region and directly engaged with said recessed central region;

providing and seating a plurality of massage balls at said recessed central region;

spacing said massage balls inside a perimeter of said raised outer peripheral edge;

providing and channeling thermal-conductive element inside a hollow channel of said raised outer peripheral edge thereby spacing said thermal-conductive element from said recessed central region; and providing and communicatively and electrically coupling a power source to said massage balls and said thermal-conductive element;

wherein said body is configured to offer healing therapy to the lower back, pelvis and coccyx of the user;

wherein said body is configured for the user to comfortably sit thereupon and further configured to elevate and support the pelvic floor and frame, which, along with said massage balls is configured to alleviate pressure and increase circulation, and decrease edema in a tissue of lower pelvic floor extremities of the user.

* * * * *